United States Patent [19]

Wirtz et al.

[11] 4,203,850

[45] May 20, 1980

[54] FOAM EXTINGUISHING AGENT

[75] Inventors: Peter Wirtz, Königstein; Richard Bröll, Langen, both of Fed. Rep. of Germany

[73] Assignee: Hoechst Aktiengesellschaft, Frankfurt am Main, Fed. Rep. of Germany

[21] Appl. No.: 925,368

[22] Filed: Jul. 17, 1978

[30] Foreign Application Priority Data

Jul. 19, 1977 [DE] Fed. Rep. of Germany ..... 2732555

[51] Int. Cl.[2] ..... A62D 1/00

[52] U.S. Cl. ..... 252/8.05; 252/3

[58] Field of Search ..... 252/3, 8.05

[56] References Cited

U.S. PATENT DOCUMENTS

| | | | |
|---|---|---|---|
| 3,562,156 | 2/1971 | Francen | 252/3 |
| 3,772,195 | 11/1973 | Francen | 252/2 |
| 4,099,574 | 7/1978 | Cooper et al. | 252/3 |

FOREIGN PATENT DOCUMENTS

| | | | |
|---|---|---|---|
| 1959798 | 6/1971 | Fed. Rep. of Germany | 252/8.05 |

*Primary Examiner*—Leland A. Sebastian

*Attorney, Agent, or Firm*—Curtis, Morris & Safford

[57] ABSTRACT

Aqueous solutions containing an aliphatic amine-N-oxide and a member of a special group of fluorinated surfactants (I) can be used with success as foaming agents for extinguishing liquid hydrocabon fires. (I) has the formula

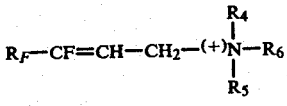

in which $R_F$ is a perfluoroalkyl group having from 3 to 16 carbon atoms, $R_4$ is a hydrogen atom, a $C_{1-4}$ alkyl, cyclohexyl or 2-hydroxyalkyl having from 2 to 6 carbon atoms, $R_5$ is a $C_{1-4}$ alkyl radical, a cyclohexyl radical or 2-hydroxyalkyl having from 2 to 6 carbon atoms and $R_6$ is a water-solubilizing radical.

5 Claims, No Drawings

FOAM EXTINGUISHING AGENT

The invention relates to aqueous fire extinguishing agents containing fluorinated surfactants and having an improved reignition behavior.

In recent time surface-active fluorine compounds have been used in fire protection, which spread out on nonpolar burning liquids to form an aqueous film blanketing the burning surface and optionally extinguishing the fire. This film, however, has a limited ability to protect a burning surface against reignition.

The problem with which the present invention was confronted was that of providing a rapidly extinguishing, water film-forming foaming agent, which should not have the aforesaid disadvantages. This agent should, consequently, have a high burnback resistance, i.e. protect the burning surface against reignition as long as possible. A foam extinguishing agent free from fatty alcohol has now been found containing in addition to water (a) an amine oxide of the formula $R_1R_2R_3N \rightarrow O$, in which $R_1$ is alkyl having of from 4 to 20 carbon atoms and $R_2$ and $R_3$ are identical or different alkyls having from 1 to 4 carbon atoms, (b) a fluorinated surfactant of the formula $$R_F-CF=CH-CH_2-\overset{R_4}{\underset{R_5}{\overset{|}{\underset{|}{(+)N}}}}-R_6, \quad (I)$$

in which $R_F$ is perfluoroalkyl having of from 3 to 16 carbon atoms, $R_4$ is a hydrogen atom, $C_{1-4}$ alkyl, cyclohexyl or 2-hydroxyalkyl having of from 2 to 6 carbon atoms, $R_5$ is $C_{1-4}$ alkyl, cyclohexyl or 2-hydroxyalkyl having of from 2 to 6 carbon atoms and $R_6$ is a water-solubilizing radical.

Normally $R_6$ is $-Q-R_7$ with Q being an alylene group having from 2 to 6, especially 2 to 3 carbon atoms and $R_7$ being a water-solubilizing polar group.

It is preferred that $R_7$ represents an anionic or non-ionic moiety. Typical anionic groups would include $-CO_2^-$, $-SO_2^-$, $-SO_3^-$, $OP(H)O_2^-$ and especially $OSO_3^\ominus$. Typical non-ionic groups would include $-N(C_2H_4OH)_2$ and especially $-OH$. If $R_7$ is a non-ionic group, the fluorinated surfactant I has to contain an anion $A^\ominus$ to neutralize the positive electric charge at the quaternary nitrogen atom.

The nature of the anion is not critical. Suitable anions include, for example, sulfate, halide, toluene, sulfonate, acetate, nitrate or methosulfate. Preferred amine oxides are alkyl-di-methylamine-N-oxides, especially N-oxides, the alkyl groups of which have of from 12 to 18, preferably 10 to 16, carbon atoms.

German patent specification No. 1,959,798 discloses foam extinguishing agents, which contain a fatty alcohol and an amine oxide in addition to a foam generator. By the combined application of higher fatty alcohol and amine oxide an increase of the foaming number and the water half life is intended.

The foaming agents according to the invention contain no further foam generator, such as protein hydrolysate or alkylbenzene sulfonate besides the amine oxide and the fluorinated surfactant. The foaming agents herein differ, furthermore, from the concentrates of the German patent specification by the absence of a fatty alcohol. It has become manifest surprisingly that the burnback resistance of the generated foam is considerably deteriorated when adding concomitantly an amine oxide and a fatty alcohol to aqueous solutions of the fluorinated surfactants of the present invention.

Foaming agents which contain a tertiary amine oxide in addition to a fluorinated surfactant are known from German Auslegeschrift No. 1,920,625. However, it can be seen from this reference that the use of the amine oxides results in undesirable properties of the extinguishing agent (slow film-forming velocity and long flare-up time), owing to the long emulsion time.

In contradistinction thereto, when using quaternary fluorinated surfactants of the formula I, the addition of the amine oxide has an essential influence on the advantageous properties of the foaming agent.

When replacing the amine oxide by other known hydrocarbon surfactants, for example anionic surfactants such as alkyl ether sulfate, the reignition behavior is unexpectedly deteriorated to a high degree.

Preferred fluorinated surfactants of the formula I are those in which the groups $R_4$ and $R_5$ are both methyl or ethyl groups.

The content of the fluorinated surfactant in the foam concentrate may vary within wide limits and may be in the range of from 0.1 to 10, especially of from 0.2 to 5, preferably of from 0.5 to 2, weight percent. The weight ratio between amine oxide and fluorinated surfactant may vary from 0.5:1 to 15:1, a ratio of from 2:1 to 10:1, especially of from 3:1 to 5:1, being preferred.

The foam concentrate according to the invention may contain other known additives, for example foam stabilizers and antifreezing agents, especially butyl diglycol and ethylene glycol, butyl diglycol being the preferred antifreezing agent.

The invention will be illustrated in the following examples:

EXAMPLES

The following standard test method was employed for determining the extinction behavior:

A circular fire basin, 1.9 m in diameter, which gives a burning area of 2.83 $m^2$, and 20 cm in height, was filled each time with 150 l of jet propellant JP 4. After a period of burn of 2 minutes, the aqueous foamable solution containing the fluorinated surfactant and having a content of foam concentrate of 6 volume percent was applied on to the burning area by means of a laboratory-type foam jet tube, at a rate of 10 l/min. of water flow, at an angle of inclination of 45° C. The foaming number (ratio between volume of the foam and volume of the liquid) was in the range of from about 7 to 8.

The following reignition test was used for determining the burnback resistance:

The above extinction test was repeated, with the exception that 2 minutes after having started the extinction (—the fire being extinguished at that monoment—) a small basin, 18 cm in diameter and 10 cm in height, which contained a layer of the same jet propellant about 5 cm in thickness, was placed into the center of the fire basin and the propellant therein was set on fire. The time until which, after transition of the flame, half of the burning area of 2.83 $m^2$ was on fire again, was determined and called "burnback resistance".

The following foaming agents were examined and the extinction time and the burnback resistance were determined. In the formulae of the fluorinated surfactants $R_f$ denotes a mixture of perfluoroalkyl groups $CF_3(C_2F_4)_n$ with n being an integer of from 2 to 7.

EXAMPLE 1: (Comparative test without amine oxide)

0.75 weight percent of fluorinated surfactant

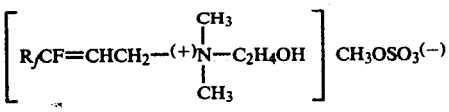

0.75 weight percent of fluorinated surfactant

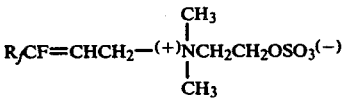

17.00 weight percent of butyl diglycol as antifreezing agent
81.50 weight percent of drinking water
100.00 weight percent of foaming agent
Extinction time: about 120 seconds
burn back resistance: 10 minutes, 30 seconds.

EXAMPLE 2

The nature and the quantity of the fluorinated surfactant and of the antifreezing agent corresponded to that of Example 1, however, instead of 81.5 weight percent of drinking water, there were used
77.5 weight percent of drinking water and
4.0 weight percent of dimethyl coconut fat amine oxide (of 30 percent concentration, the remainder being water).
Extinction time: 75 seconds,
burnback resistance: 16 minutes.

EXAMPLE 3

The nature and the quantity of the mixture of fluorinated surfactants and of butyl diglycol corresponded to that of Example 1, however, instead of 81.5 weight percent of drinking water there were used
6 weight percent of amine oxide of Example 2 and
75.5 weight percent of drinking water.
Extinction time: 65 seconds,
burnback resistance: 12 minutes.

EXAMPLE 4

The nature and the quantity of the mixture of fluorinated surfactants and of antifreezing agent corresponded to that of Example 1, however, instead of 81.4 weight percent of drinking water there were used
11 weight percent of amine oxide of Example 2 and
70.5 weight percent of drinking water.
Extinction time: 90 seconds,
burnback resistance: about 7 minutes.

EXAMPLE 5

0.75 weight percent of

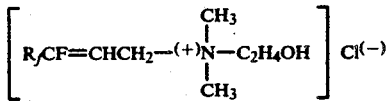

0.75 weight percent of fluorinated surfactant

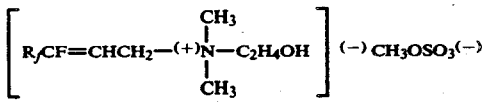

4.00 weight percent of amine oxide of Example 2 (30 percent concentration)
17.00 weight percent of butyl diglycol
74.50 weight percent of drinking water
100.00 weight percent of foaming agent
Extinction time: 60 seconds
burnback resistance: 13 minutes

EXAMPLE 6

1.50 weight percent of fluorinated surfactant

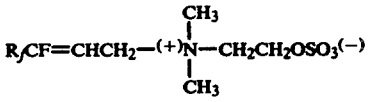

17.00 weight percent of butyl diglycol
4.00 weight percent of amine oxide of Example 2 (30 percent concentration)
74.50 weight percent of drinking water
100.00 weight percent of foaming agent
Extinction time: 70 seconds
burnback resistance: 12 minutes, 15 seconds.

EXAMPLE 7: (Comparative Example)

The example was carried out using a commercially available water film-forming foaming agent having a content of fluorinated surfactant of about 1.7 percent (about 15 to 20 weight percent of butyl diglycol, about 78 weight percent of water and about 1 to 2 weight percent of hydrocarbon surfactant).

This foaming agent was foamed under the conditions of Example 1.
Extinction time: 70 seconds
burnback resistance: 11 minutes, 15 seconds.

What is claimed is:

1. A fire extinguishing concentrate, based on water and a fluorinated surfactant as foam formers, which comprises:

(a) an amine oxide of the formula $R_1R_2R_3N \rightarrow O$, in which $R_1$ is alkyl of 4 to 20 carbon atoms and $R_2$ and $R_3$ are identical or different alkyls of 1 to 4 carbon atoms, and (b) a fluorinated surfactant of the formula

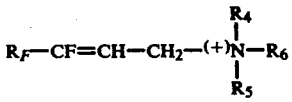

(I)

in which $R_F$ is perfluoroalkyl of 3 to 16 carbon atoms, $R_4$ is a hydrogen atom, $C_{1-4}$ alkyl, cyclohexyl, or 2-hydroxyalkyl of 2 to 6 carbon atoms, $R_5$ is $C_{1-4}$ alkyl, cyclohexyl, or 2-hydroxyalkyl of 2 to 6 carbon atoms, and $R_6$ is a water solubilizing radical.

2. The fire extinguishing concentrate defined in claim 1 further comprising butyl diglycol of from 10 to 30 weight percent.

3. The fire extinguishing concentrate as defined in claim 1, wherein the amine oxide is present from 1 to 8, in weight, by percent.

4. The fire extinguishing concentrate as defined in claim 1, wherein the amine oxide is present from 2 to 6, in weight, by percent.

5. The fire extinguishing concentrate as defined in claim 1, wherein the amine oxide is present from 3 to 5, in weight, by percent.

* * * * *